US007772788B2

(12) United States Patent
Park et al.

(10) Patent No.: US 7,772,788 B2
(45) Date of Patent: Aug. 10, 2010

(54) METHOD FOR DRIVING A LIGHT SOURCE AND BACKLIGHT ASSEMBLY EMPLOYING THE SAME

(75) Inventors: Se-Ki Park, Suwon-si (KR); Gi-Cherl Kim, Yongin-si (KR); Moon-Hwan Chang, Cheonan-si (KR); Eun-Jeong Kang, Cheonan-si (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 12/058,951

(22) Filed: Mar. 31, 2008

(65) Prior Publication Data

US 2008/0272701 A1 Nov. 6, 2008

(30) Foreign Application Priority Data

May 2, 2007 (KR) ..... 10-2007-0042449

(51) Int. Cl.
*H05B 37/02* (2006.01)

(52) U.S. Cl. ..... 315/291; 315/151; 315/307; 345/83; 345/102

(58) Field of Classification Search ..... 315/149, 315/151, 155, 307–308; 345/83, 88, 101–102; 349/108–109
See application file for complete search history.

(56) References Cited

U.S. PATENT DOCUMENTS 7,324,076 B2 * 1/2008 Lee et al. ..... 345/83
2002/0149576 A1 * 10/2002 Tanaka et al. ..... 345/204
2005/0140612 A1 * 6/2005 Baek ..... 345/83
2006/0066266 A1 * 3/2006 Li Lim et al. ..... 315/291
2007/0019145 A1 * 1/2007 Rho et al. ..... 349/144
2007/0182887 A1 * 8/2007 Haga et al. ..... 349/106
2007/0211013 A1 * 9/2007 Uehara et al. ..... 345/102
2007/0278974 A1 * 12/2007 Van De Ven ..... 315/324
2009/0021471 A1 * 1/2009 Park et al. ..... 345/102

FOREIGN PATENT DOCUMENTS

JP 2006-106437 4/2006
KR 1020060102286 A 9/2006
KR 1020060105483 A 10/2006

* cited by examiner

*Primary Examiner*—Douglas W Owens
*Assistant Examiner*—Tung X Le
(74) *Attorney, Agent, or Firm*—Cantor Colburn LLP

(57) ABSTRACT

In a method of driving a light source, light generated by a light source is sensed in order to detect color coordinates of a red color, color coordinates of a green color and color coordinates of a blue color. A light source color space formed by the color coordinates of the red, green and blue colors is compared with a reference color space formed by red reference color coordinates, green reference color coordinates and blue reference color coordinates. Then, color temperature of the light generated by the light source is controlled so that the light source color space covers the reference color space.

25 Claims, 11 Drawing Sheets

METHOD FOR DRIVING A LIGHT SOURCE AND BACKLIGHT ASSEMBLY EMPLOYING THE SAME

This application claims priority to Korean Patent Application No. 2007-42449, filed on May 2, 2007, and all the benefits accruing therefrom under 35 U.S.C. §119, the contents of which in its entirety are herein incorporated by reference.

BACKGROUND OF THE INVENTION

1. Field of the Invention

The present invention relates to a method of driving a light source and a backlight assembly employing the method. More particularly, the present invention relates to a method of driving a light source, which is capable of improving color reproducibility, and a backlight assembly employing the method.

2. Description of the Related Art

A liquid crystal display ("LCD") apparatus is a non-emissive type display apparatus, such that the LCD apparatus requires a backlight assembly providing a display panel of the LCD apparatus with light.

Nowadays, large screen LCD apparatuses, such as televisions, include backlight assemblies having red-green-blue ("RGB") light-emitting diodes ("LEDs") for displaying images having high color reproducibility are being developed. The LCD apparatus requires an image having high color reproducibility and meeting the requirements of the Adobe RGB color space, which is a standard color space made by Adobe Systems Incorporated, U.S.A.

The color ranges displayed by monitors, digital printers, output devices of a printing office, etc., are limited. The color range displayed by a digital device is defined as a color space.

The Adobe RGB color space includes a broad color range. Particularly, the Adobe RGB color space includes broad color ranges corresponding to green and blue colors. The Adobe RGB color space is employed in printers, scanners, digital cameras, monitors, etc.

When the Adobe RGB color space is used in image data, a monitor is required to display an image of the wide color range to support the Adobe RGB color space, thereby displaying the image having required colors. Accordingly, the LCD apparatus including the LEDs may meet the requirements of the Adobe RGB color space.

The LCD apparatus emits light having high color reproducibility so that a color space of the LCD apparatus covers the Adobe RGB color space. A spectrum of light generated from the backlight assembly may be matched to a spectrum of light passing through color filters formed in the display panel so that the LCD apparatus emits the light having the high color reproducibility.

BRIEF SUMMARY OF THE INVENTION

The brightness of the light emitted from the LCD apparatus decreases since the LEDs are heated as time passes. When the brightness of the light decreases, the Adobe RGB color space may be changed and the color space of the LCD apparatus may not cover the Adobe RGB color space.

Thus, the present invention provides a method of driving a light source capable of meeting the requirements of the Adobe RGB color space in real-time through controlling a color temperature.

The present invention further provides a backlight assembly for performing the method.

In exemplary embodiments of the present invention, a method of driving a light source includes sensing light generated by a light source in order to detect color coordinates of a red color, color coordinates of a green color and color coordinates of a blue color. Then, a light source color space formed by the color coordinates of the red, green and blue colors is compared with a reference color space formed by red reference color coordinates, green reference color coordinates and blue reference color coordinates. Then, a color temperature of the light generated by the light source is controlled so that the light source color space covers the reference color space.

Controlling the color temperature of the light may include controlling a driving current applied to the light source so that the color coordinates of the red color, the color coordinates of the green color and the color coordinates of the blue color may be respectively moved into a red color coordinate control region, a green color coordinate control region and a blue color coordinate control region.

Comparing the light source color space with the reference color space may include determining a covering area of a region of the reference color space which is covered by the light source color space.

In other exemplary embodiments of the present invention, a backlight assembly includes a light source, a light source driver, a light source sensor, and a color space controller. The light source includes a red light-emitting chip generating red light, a green light-emitting chip generating green light and a blue light-emitting chip generating blue light. The light source driver applies a driving current to the light source to drive the light source. The light source sensor senses light generated by the light source. The color space controller compares a light source color space formed by color coordinates of red, green and blue colors with a reference color space formed by red, green and blue reference color coordinates and controls color temperature of the light generated by the light source. The color coordinates of the red, green and blue colors are detected from the red light, the green light and the blue light.

The color space controller may further include a memory. The memory may store a red color coordinate equation, a green color coordinate equation and a blue color coordinate equation. The red color coordinate equation may illustrate a variation of the color coordinates of the red color according to the color temperature. The green color coordinate equation may illustrate a variation of the color coordinates of the green color according to the color temperature. The blue color coordinate equation may illustrate a variation of the color coordinates of the blue color according to the color temperature.

According to the method of driving a light source and the backlight assembly for performing the method, the color temperature of light generated by the light source may be controlled in real-time so that the light source color space may cover the Adobe RGB color space. Therefore, the color reproducibility of the display apparatus may be improved.

BRIEF DESCRIPTION OF THE DRAWINGS

The above and other features and advantages of the present invention will become more apparent by describing in detailed exemplary embodiments thereof with reference to the accompanying drawings, in which.

DETAILED DESCRIPTION OF THE INVENTION

Figure 1:
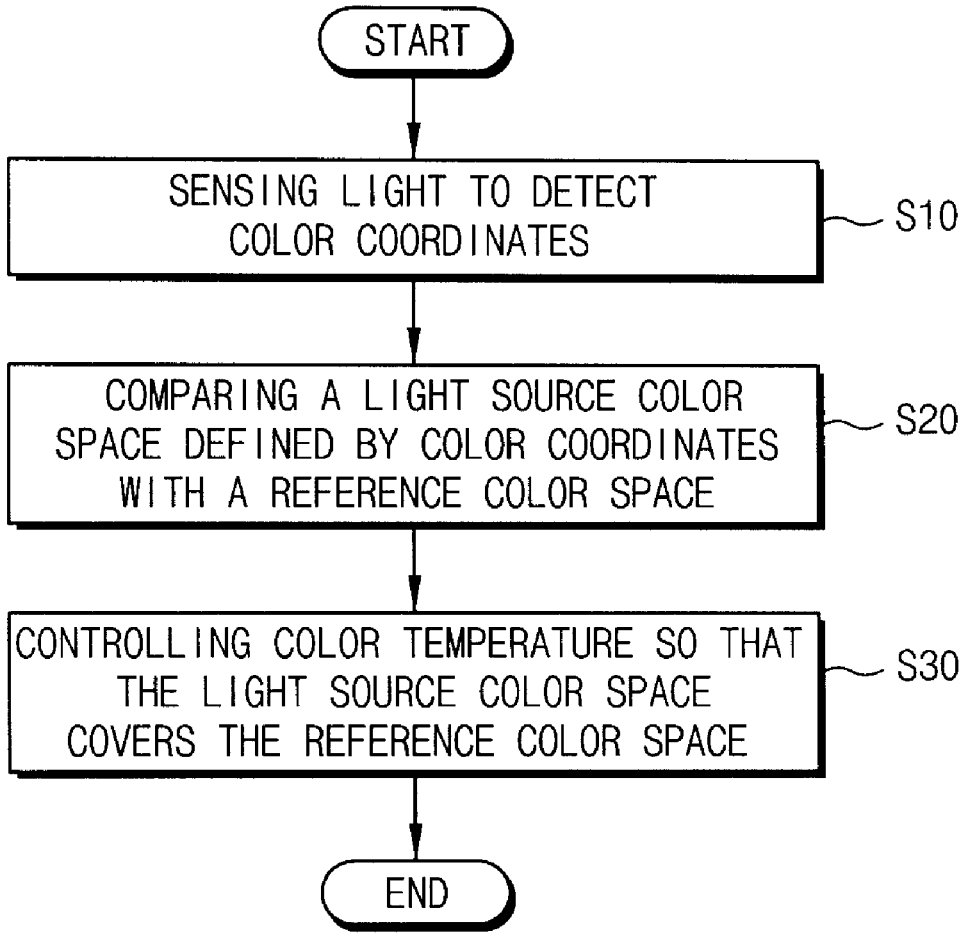
FIG. 1 is a flow chart illustrating an exemplary method for driving a light source according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

Figure 2:
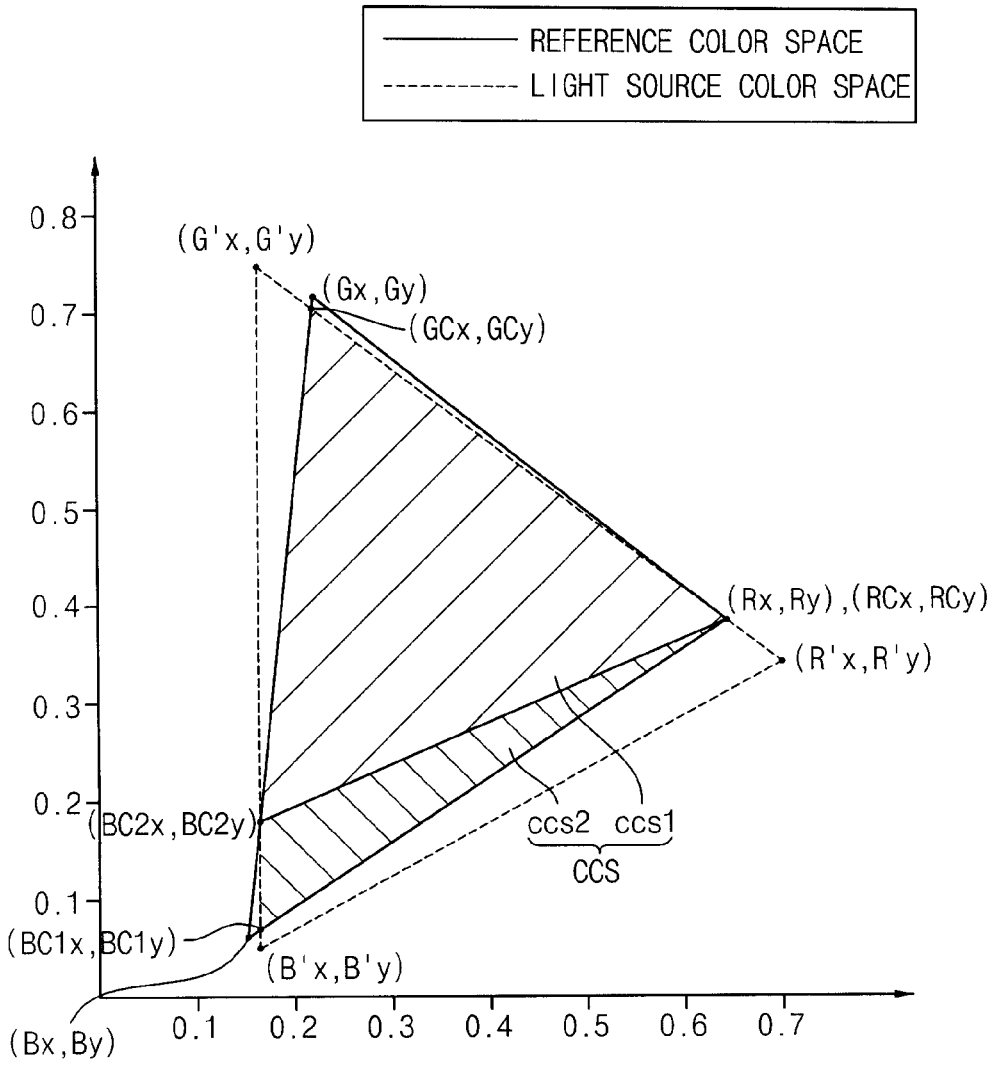
FIG. 2 is a graph comparing a color space of an exemplary light source with a reference color space.

FIG. 1 is a flow chart illustrating an exemplary method for driving an exemplary light source according to an exemplary embodiment of the present invention. FIG. 2 is a graph comparing a color space of an exemplary light source with a reference color space.

Referring to FIG. 1, in the exemplary method for driving an exemplary light source according to an exemplary embodiment of the present invention, light generated by the light source is sensed to detect color coordinates respectively corresponding to a red color, a green color and a blue color. A color space of the light source defined by the color coordinates corresponding to the red color, the green color and the blue color is compared with a reference color space. When the color space of the light source defined by the color coordinates corresponding to the red color, the green color and the blue color does not cover the reference color space, the color temperature of light generated by the light source is controlled to change the color coordinates corresponding to the red color, the green color and the blue color so that the color space of the light source defined by the color coordinates corresponding to the red color, the green color and the blue color covers the reference color space.

More particularly, light generated by the light source is detected (Step S10). The light source generates red light, green light and blue light to generate white light. Amounts of each of the red, green and blue lights generated by the light source are detected so that a red light voltage Vr corresponding to the red light, a green light voltage Vg corresponding to the green light, and a blue light voltage Vb corresponding to the blue light are generated.

Color coordinates of a red color, a green color and a blue color are determined through the detected red, green and blue light so that the color coordinates of the red, green and blue colors form a color space of the light source. For example, analog values of the red light voltage Vr, the green light voltage Vg and the blue light voltage Vb are converted into digital values of the red light voltage Vr, the green light voltage Vg and the blue light voltage Vb to form the color space of the light source.

The color space of the light source formed by the color coordinates of the red, green and blue colors is compared with a reference color space (Step S20).

The reference color space may refer to a standard color space which meets requirements for high color reproducibility, a user's requirements for a color space, etc. Since some light data is lost during a process in which the analog data of the light is converted into digital data, a digital device, such as a monitor, a printer, etc., display colors which are in a restricted range. The restricted range of the colors displayed by the digital device corresponds to a color space.

Referring to FIG. 2, the color space of the light source and the reference color space are shown through an XY color coordinate system. In FIG. 2, a horizontal axis corresponds to an x-axis and a vertical axis corresponds to a y-axis. When the light source includes three light sources respectively generating the red light, the green light and the blue light, the light source may display colors corresponding to all color coordinates in a space defined by color coordinates of the red, green and blue colors of the red light, the green light and the blue light.

The reference color space is formed by red reference color coordinates, green reference color coordinates and blue reference color coordinates. The red reference color coordinates are (Rx, Ry), the green reference color coordinates are (Gx, Gy) and the blue reference color coordinates are (Bx, By).

The color space of the light source is formed by color coordinates of the red color, color coordinates of the green color and color coordinates of the blue color. The color coordinates of the red color are (R'x, R'y), the color coordinates of the green color are (G'x, G'y), and the color coordinates of the blue color are (B'x, B'y). When the color coordinates of the red, green and blue colors (R'x, R'y), (G'x, G'y), (B'x, B'y) are different from the red, green and blue reference color coordinates (Rx, Ry), (Gx, Gy), (Bx, By), the color space of the light source partially overlaps with the reference color space.

When the color coordinates forming the color space of the light source are determined, the color space of the light source is compared with the reference color space. When a distance between each of the color coordinates of the red, green and blue colors (R'x, R'y), (G'x, G'y), (B'x, B'y) and a central point of the reference color space is greater than a distance between each of the red, green and blue reference color coordinates (Rx, Ry), (Gx, Gy), (Bx, By) and the central point of the reference color space, the color space of the light source entirely covers the reference color space.

For example, the reference color space may include the Adobe RGB color space. When the color space of the light source entirely covers the Adobe RGB color space, a range of colors displayed using light generated by the light source may be greater than a range of colors in the Adobe RGB color space. When the color space of the light source partially covers the Adobe RGB color space, the range of the colors displayed using the light generated by the light source may be smaller than the range of colors in the Adobe RGB color space, in which case the colors displayed using the light generated by the light source may not include some colors in the Adobe color space.

In the exemplary embodiment of the present invention, the reference color space includes the Adobe RGB color space. The Adobe RGB color space has a wide range of colors. The Adobe RGB color space also has high red, green and blue colors. As will be further described below, in the present invention, the color temperature of light is controlled so that the color space of the light source covers the Adobe RGB color space, as described by Step S30.

When the color space of the light source covers the reference color space as determined by a comparison performed in Step S20, then Step S10, in which the light generated by the light source is detected, is again performed. When the color space of the light source does not cover the reference color space as determined by a comparison performed in Step S20, then the color temperature of the light generated by the light source is controlled so that the color space of the light source covers the reference color space (Step S30). In an exemplary embodiment of the present invention, the color temperature of the light may be continuously controlled in real-time according to the light emitted from the light source. In another exemplary embodiment of the present invention, the color temperature of the light may be discontinuously controlled in random intervals or regular intervals according to the light emitted from the light source.

The color temperature corresponds to a temperature of a black body heated to have the same color as the light generated by the light source. In the present exemplary embodiment, the color temperature corresponds to the temperature of the black body heated to have a white color. A driving current applied to the light source may be controlled in order to control the color temperature.

The light generated by the light source has an arbitrary color temperature. The color temperature of the light generated by the light source may be controlled to change white color coordinates of white light in the XY color coordinate system. The white color coordinates (W'x, W'y) of the white light, which are formed by mixing the red light, the green light and the blue light, corresponds to a central point of the color space of the light source. When the white color coordinates (W'x, W'y) are changed, the color coordinates of the red, green and blue colors (R'x, R'y), (G'x, G'y), (B'x, B'y) may be changed.

When the color temperature is changed, the color coordinates of the red, green and blue colors (R'x, R'y), (G'x, G'y), (B'x, B'y) are changed according to a predetermined pattern. In consideration of the changing pattern of the color coordinates of the red, green and blue colors (R'x, R'y), (G'x, G'y), (B'x, B'y), the color coordinates of the red, green and blue colors (R'x, R'y), (G'x, G'y), (B'x, B'y) are moved into an outside region of the space formed by the red, green and blue reference color coordinates (Rx, Ry), (Gx, Gy), (Bx, By) so that the color space of the light source covers the reference color space.

Figure 3:
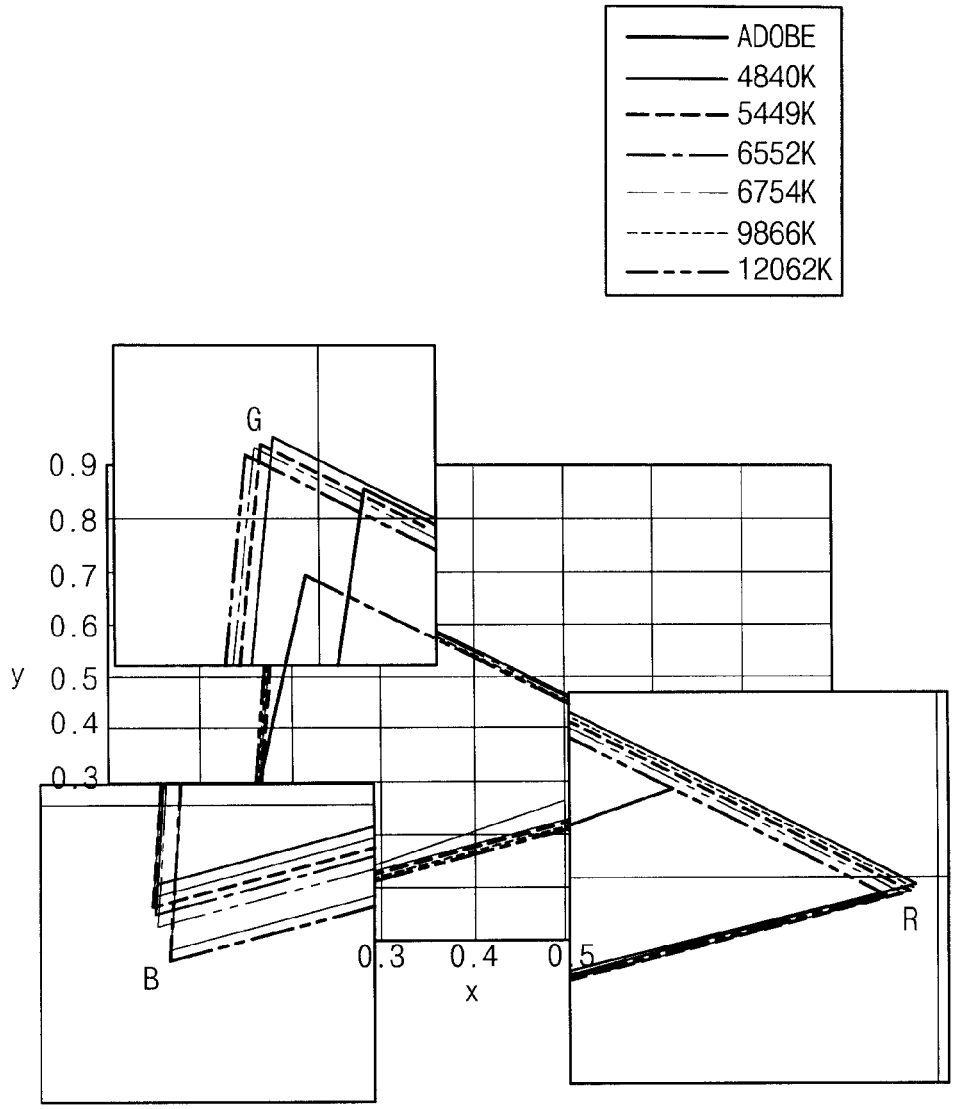
FIG. 3 is a graph illustrating variations of color coordinates of the exemplary light source according to a color temperature in an XY color coordinate system.
Figure 4:
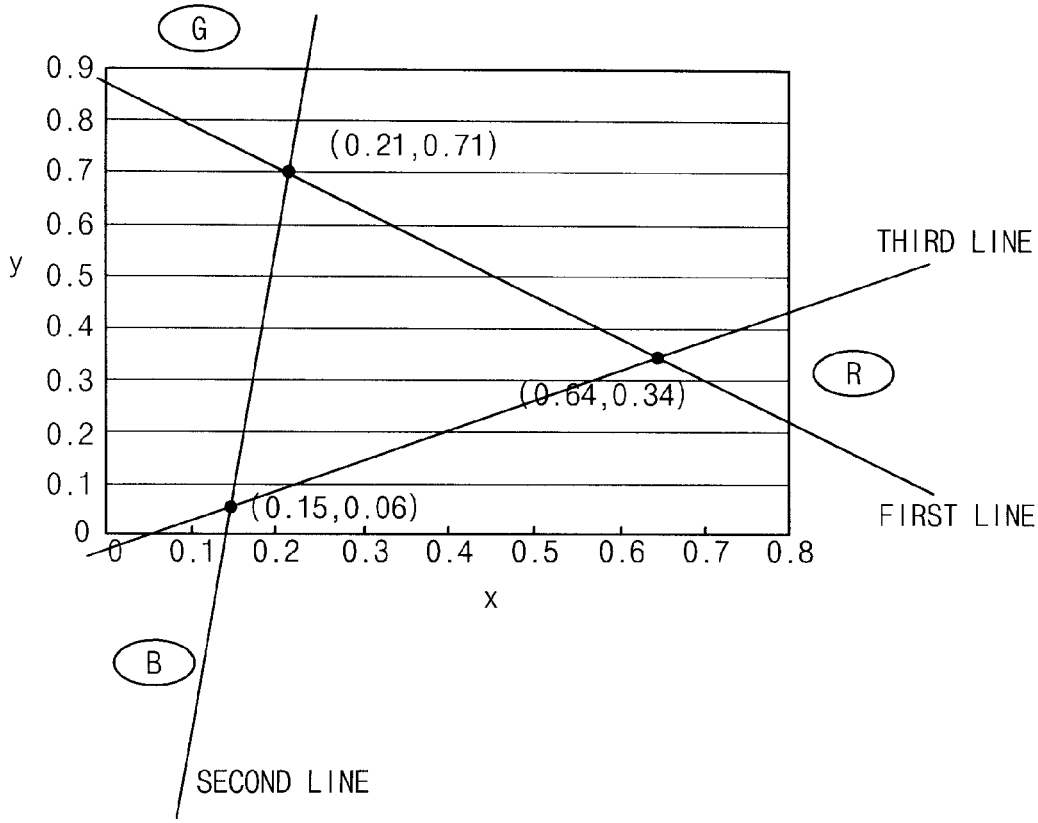
FIG. 4 is a graph illustrating space controlling color coordinates in an XY color coordinate system.

FIG. 3 is a graph illustrating variations of color coordinates of the exemplary light source according to a color temperature in an XY color coordinate system. FIG. 4 is a graph illustrating space controlling color coordinates in an XY color coordinate system.

With reference to FIGS. 2 and 3, and as will be further described below, the change pattern of the red, green and blue colors (R'x, R'y), (G'x, G'y), (B'x, B'y) according to a change of the color temperature may be represented by equations. Paths of moving the color coordinates of the red, green and blue colors (R'x, R'y), (G'x, G'y), (B'x, B'y) may be predicted by the equations. In addition, the color coordinates of the red, green and blue colors (R'x, R'y), (G'x, G'y), (B'x, B'y) may be changed according to the equations.

Referring to FIG. 3, the red, green and blue colors may have XY coordinates in the XY color coordinate system. In an exemplary embodiment of the present invention, the color temperature of the light generated by the light source may be in a range of absolute temperature of about 4500K to about 12000K.

TABLE 1A

| | R | G | B |
|---|---|---|---|
| X | 0.6956 | 0.1886 | 0.1493 |
| Y | 0.2963 | 0.7298 | 0.0742 |

TABLE 1B

| | R | G | B |
|---|---|---|---|
| X | 0.6945 | 0.1881 | 0.1502 |
| Y | 0.2958 | 0.7283 | 0.0666 |

TABLE 1C

| | R | G | B |
|---|---|---|---|
| X | 0.6926 | 0.1854 | 0.1503 |
| Y | 0.2955 | 0.7288 | 0.0644 |

TABLE 1D

| | R | G | B |
|---|---|---|---|
| X | 0.6923 | 0.1859 | 0.1508 |
| Y | 0.2951 | 0.7271 | 0.0605 |

TABLE 1E

| | R | G | B |
|---|---|---|---|
| x | 0.6885 | 0.1836 | 0.1514 |
| y | 0.2938 | 0.7252 | 0.0539 |

TABLE 1F

| | R | G | B |
|---|---|---|---|
| X | 0.6869 | 0.1842 | 0.1519 |
| Y | 0.2932 | 0.7236 | 0.0506 |

In Table 1A, the color temperature of the light generated by the light source is about 4840K and a ratio of the color space of the light source to the reference color space is about 99.585%. In Table 1B, the color temperature of the light generated by the light source is about 5449K and the ratio of the color space of the light source to the reference color space is about 99.899%. In Table 1C, the color temperature of the light generated by the light source is about 6552K and the ratio of the color space of the light source to the reference color space is about 99.695%. In Table 1D, the color temperature of the light generated by the light source is about 6754K and the ratio of the color space of the light source to the reference color space is about 99.241%. In Table 1E, the color temperature of the light generated by the light source is about 9866K and the ratio of the color space of the light source to the reference color space is about 97.925%. In Table 1F, the color temperature of the light generated by the light source is about 12062K and the ratio of the color space of the light source to the reference color space is about 97.364%. For example, as shown in FIG. 4, the red reference color coordinates may be (0.64, 0.34), the green reference color coordinates may be (0.21, 0.71), and the blue reference color coordinates may be (0.15, 0.06).

Referring to Tables 1A to 1F, when the color temperature of the light generated by the light source increases, the x-components and the y-components of the color coordinates of the red color and the color coordinates of the green color may generally decrease. Also when the color temperature of the light generated by the light source increases, the x-component of the blue color may increase and the y-component of the color coordinates of the blue color may decrease. In addition, the ratio of the color space of the light source to the reference color space may be changed according to the change of the color coordinates of the red, green and blue colors.

A change ratio of the color coordinates of the red color according to the color temperature may be smaller than a change ratio of each of the color coordinates of the green and blue colors according to the color temperature. The reference color space may include the Adobe RGB color space.

The equation concerning the color coordinates of the green color illustrates a relation of the x-component and the y-component of the color coordinates of the green color when the color temperature of the light generated by the light source increases.

For example, the equation concerning the color coordinates of the green color may be deduced through a polynomial regression method and represented as $y1=A+B_1x_1+B_2(x_1)^2$, wherein A is −5.293, $B_1$ is 63.733, and $B_2$ is −168.618. $x_1$ corresponds to the x-component of the color coordinates of the green color and $y_1$ corresponds to the y-component of the color coordinates of the green color. According to the equation concerning the color coordinates of the green color and Tables 1A to 1F, the x-component and the y-component of the color coordinates of the green color decrease when the color temperature increases.

The equation concerning the color coordinates of the blue color illustrates a relation of the x-component and the y-component of the color coordinates of the blue color when the color temperature of the light generated by the light source increases.

For example, the equation concerning the color coordinates of the blue color may be deduced through a linear regression method and represented as $y2=C+Dx_2$, wherein C is 1.462 and D is −9.297. $x_2$ corresponds to the x-component of the color coordinates of the blue color, and $y_2$ corresponds to the y-component of the color coordinates of the blue color. According to the equation concerning the color coordinates of the blue color and Tables 1A to 1F, the x-component of the color coordinates of the blue color increase and the y-component of the color coordinates of the blue color decrease when the color temperature increases.

A lookup table may be formed to illustrate a relation of the color temperature and the color coordinates of the red, green and blue colors because the color coordinates of the red, green and blue colors are changed in the pattern according to the variation of the color temperature as mentioned above. The lookup table may then be used as a reference for controlling color temperature so that the light source color space covers the reference color space.

Referring to FIG. 4, the distance between each of the color coordinates of the red, green and blue colors and the color coordinates of the white color may be greater than the distance between each of the red, green blue reference color coordinates so that the color space of the light source covers the reference color space. In addition, a distance between the color coordinates of the white color and a line connecting the color coordinates of the green color with the color coordinates of the blue color may be greater than a distance between the color coordinates of the white color and a line connecting the green reference color coordinates with the blue reference color coordinates so that the color space of the light source covers the reference color space.

A specific region, which is hereinafter referred to as a color coordinate controlling region, is determined so that the color space of the light source covers the reference color space. The color coordinates of the light generated by the light source is in the color coordinate controlling region. For example, the color coordinates of the red color are in a red color coordinate controlling region R, the color coordinates of the green color are in a green color coordinate controlling region G and the color coordinates of the blue color are in a blue color coordinate controlling region B so that the color space of the light source covers the reference color space.

In the exemplary embodiment, in the XY color coordinate system, the reference color space is formed by the red reference color coordinates of (0.64, 0.34), the green reference color coordinates of (0.21, 0.71), and the blue reference color coordinates of (0.15, 0.06). For example, the reference color space is formed by a first line, which is represented as an equation of $y=-0.86x+0.8904$, connecting the red reference color coordinates with the green reference color coordinates, a second line, which is represented as an equation of $y=10.83x-1.56$, connecting the green reference color coordinates with the blue reference color coordinates, and a third line, which is represented as an equation of $y=0.57x-0.025$, connecting the blue reference color coordinates with the red reference color coordinates.

The red color coordinate controlling region R corresponds to an outside region of the reference color space adjacent to the red reference color coordinates. For example, the red color coordinate controlling region R is disposed between the first line and the third line and the x-component of the color coordinates in the red color coordinate controlling region R is greater than the x-component of the red reference color coordinates. In the exemplary embodiment, the x-component of the color coordinates in the red color coordinate controlling region R is greater than 0.64.

The green color coordinate controlling region G corresponds to an outside region of the reference color space adjacent to the green reference color coordinates. For example, the green color coordinate controlling region G is disposed between the first line and the second line and the y-component of the color coordinates in the green color coordinate controlling region G is greater than the y-component of the green reference color coordinates. In the exemplary embodiment, the y-component of the color coordinates in the green color coordinate controlling region G is greater than 0.71.

The blue color coordinate controlling region B corresponds to an outside region of the reference color space adjacent to the blue reference color coordinates. For example, the blue color coordinate controlling region B is disposed between the second line and the third line and the y-component of the color coordinates in the blue color coordinate controlling region B is less than the y-component of the blue reference color coordinates. In the exemplary embodiment, the y-component of the color coordinates in the blue color coordinate controlling region B is less than 0.06.

The color coordinates of the red, green and blue colors may be moved into the red, green and blue color coordinate controlling regions R, G, B by a change of the color temperature based on the equations and the color coordinate controlling regions R, G, B.

For example, the color coordinates of the red, green and blue colors may be changed by using the above-described lookup table illustrating the relations between the color temperature and the color coordinates. The x-components and the y-components of the red, green and blue colors may be changed based on the equations to be in the red, green and blue color coordinate controlling regions R, G, B.

For example, when the color coordinates of the blue color of about (0.1519, 0.0506) is in an outside region of the blue color coordinate controlling region B, the color temperature of the blue light is changed by using the equation represented as $y2=C+Dx_2$, wherein $C=1.462$ and $D=-9.297$.

The x-component of the color coordinates of the blue color of (0.1591, 0.0506) decreases and the y-component of the color coordinates of the blue color increases so that the color coordinates of the blue color are in the blue color coordinate controlling region B.

In the XY color coordinate system, a decrease of the x-component means a decrease of an amount of red light or an increase of an amount of blue light, and an increase of the y-component means a decrease of the amount of the blue light or an increase of an amount of green light. As in the above-described example, when the color coordinates of the blue color are (0.1519, 0.0506), the temperature is controlled such that the amount of the red light generated by the light source decreases and the amount of the green light generated by the light source increases so that the color coordinates of the blue color are in the blue color coordinate controlling region B. The color coordinates of the red and green colors may be in their respective color coordinate controlling regions through the same method of the blue light described above.

When the equations concerning the color coordinates are determined according to the color temperature, the color coordinates of the red, green and blue colors may be changed to be in the color coordinate controlling regions R, G, B based on the equations. The color space formed by the changed color coordinates may cover the reference color space.

Referring to FIGS. 2 and 4, in order to compare the color space of the light source with the reference color space, a covering area ("CA") at which the color space of the light source covers the reference color space may be determined. In other words, the color space of the light source covers a portion of the reference color space corresponding to the covering area CA.

Three light source lines forming the color space of the light source may be represented as equations and the equations representing the three light source lines may be calculated by using the color coordinates of the red, green and blue colors. Three reference lines forming the reference color space may be represented as equations and the equations representing the three reference lines may be calculated by using the reference color coordinates. When each of the light source lines cross the three reference lines, the covering area CA by which the color space of the light source covers the reference color space may be calculated by using crossing coordinates at which the light source lines cross the reference lines.

As shown in FIG. 2, when the crossing coordinates include red crossing coordinates (RCx, RCy), green crossing coordinates (GCx, GCy), first blue crossing coordinates (BC1$x$, BC1$y$), and second blue crossing coordinates (BC2$x$, BC2$y$), a crossing color space CCS which corresponds to the covering area CA includes a first crossing color space ccs1 and a second crossing color space ccs2. The total area of the crossing color space CCS is the sum of an area of the first crossing color space ccs1 and an area of the second crossing color space ccs2.

For example, the first crossing color space ccs1 is formed by the red crossing coordinates (RCx, RCy), the green crossing coordinates (GCx, GCy) and the first blue crossing coordinates (BC1$x$, BC1$y$), and the area of the first crossing color space ccs1 is represented as ½x{(RCxGCy+GCxBC2$y$+BC2$x$RCy)−(GCxRCy+BC2$x$GCy+RCxBC2$y$)}. The second crossing color space ccs2 is formed by the red crossing coordinates (RCx, RCy), the green crossing coordinates (GCx, GCy) and the second blue crossing coordinates (BC2$x$, BC2$y$), and the area of the second crossing color space ccs2 is represented as ½x{(RCxBC1$y$+BC1$x$BC2$y$+BC2$x$RCy)−(BC1$x$RCy+BC2$x$BC1$y$+RCxBC2$y$)}. The area of the reference color space is represented as ½x{(RxGy+GxBy+BxRy)−(GxRy+BxGy+RxBy)}.

When the area of the crossing color space CCS is determined, a ratio of the area of the crossing color space CCS to the area of the reference color space is determined so that a covering ratio of the color space of the light source to the reference color space is determined. The covering ratio may be compared with a predetermined reference ratio required by a user.

For example, when the covering ratio is smaller than the reference ratio, a current applied to the light source may be controlled so that the covering ratio increases. Alternatively, when the covering ratio is larger than or the same as the reference ratio, the current applied to the light source may not be changed so that the color space of the light source remains.

The reference ratio may be in a range of about 99% to 100% so that the color space of the light source entirely, or at least substantially, covers the reference color space.

As described above, the covering area CA by which the color space covers the reference color space is calculated before the color coordinates of the light source are moved into the color coordinate controlling regions R, G, B. For example, when the ratio of the color space of the light source to the reference color space is smaller than the reference ratio, the color temperature is controlled so that the color coordinates of the light source are moved into the color coordinate controlling regions R, G, B. Alternatively, when the ratio of color space of the light source to the reference color space is greater than or the same as the reference ratio, the color temperature may not be changed.

Figure 5:
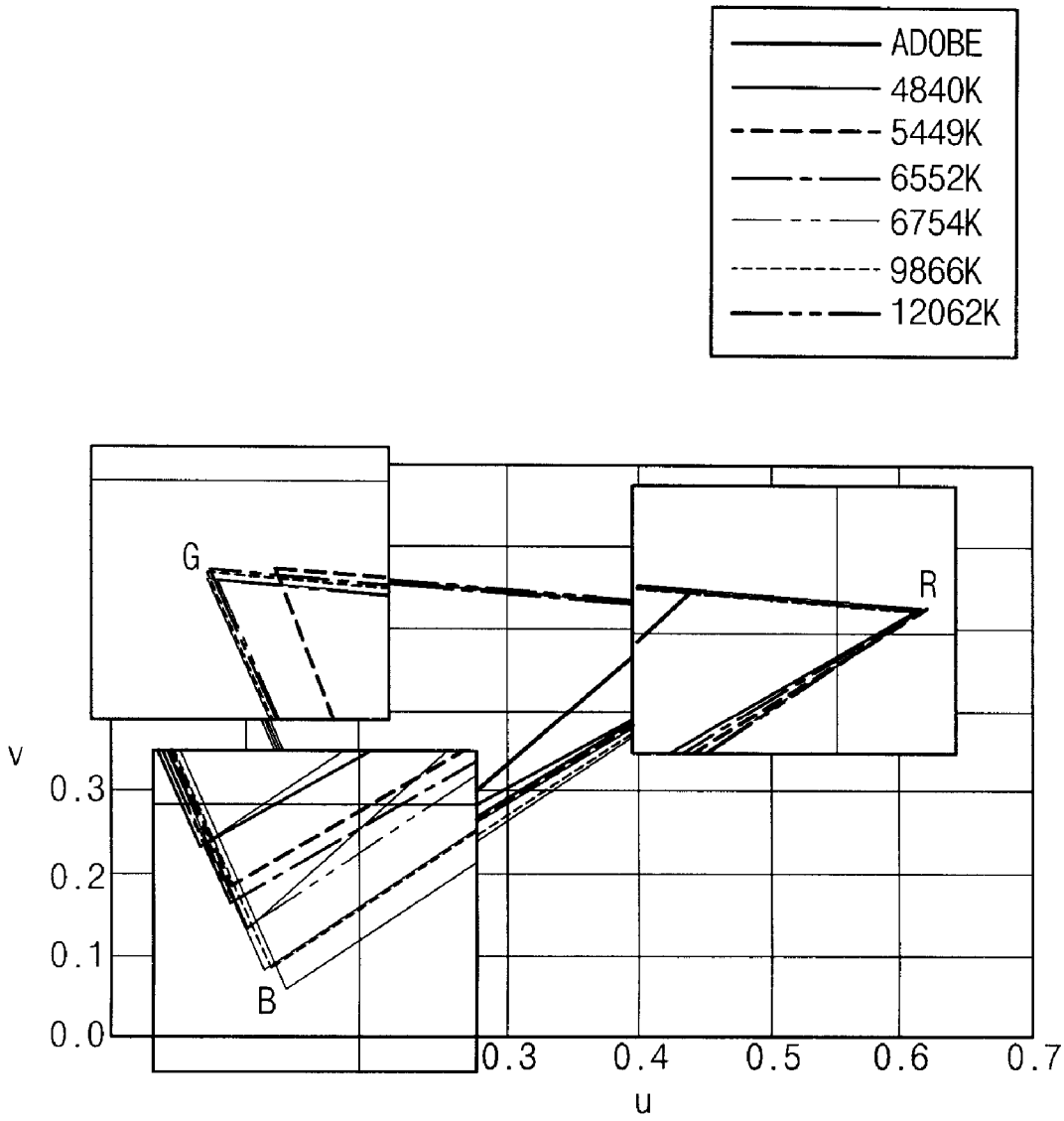
FIG. 5 is a graph illustrating variations of color coordinates of the exemplary light source according to a color temperature in a UV color coordinate system.
Figure 6:
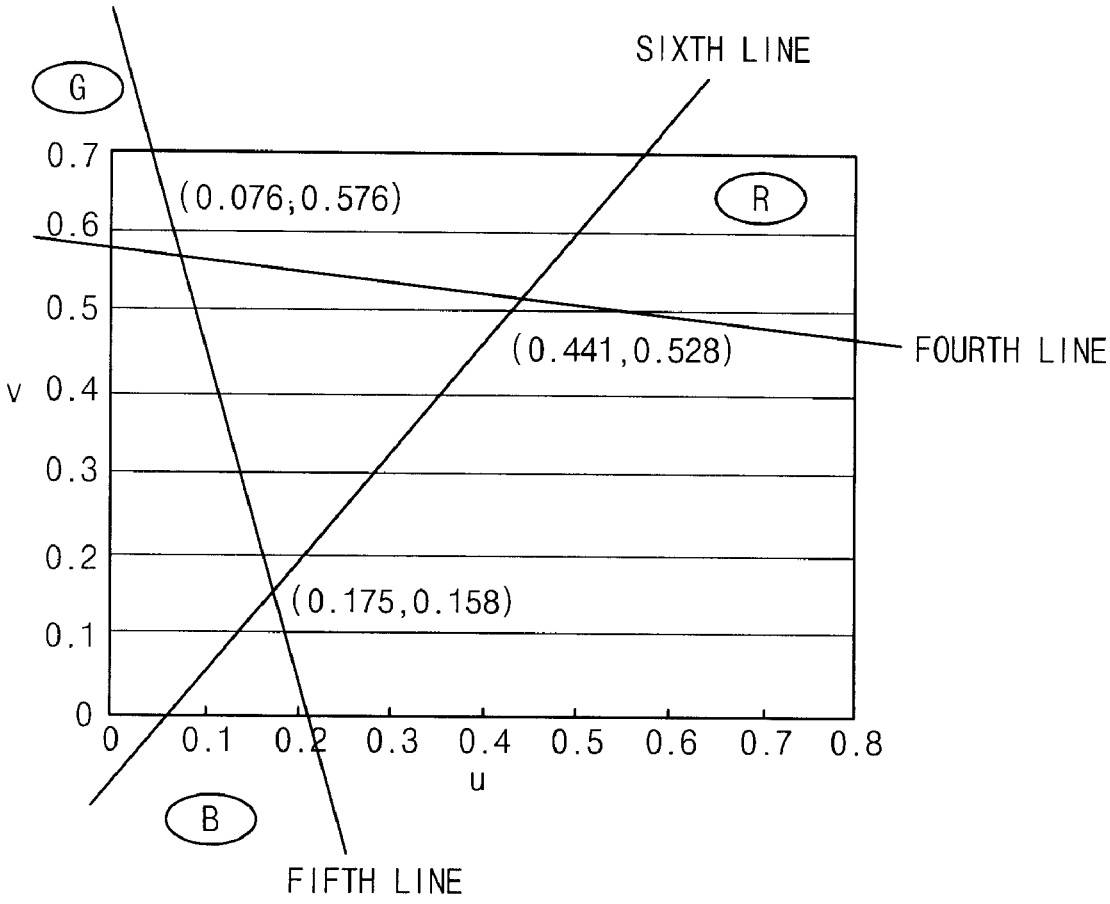
FIG. 6 is a graph illustrating space controlling color coordinates in a UV color coordinate system.

FIG. 5 is a graph illustrating variations of color coordinates of the exemplary light source according to a color temperature in a UV color coordinate system. FIG. 6 is a graph illustrating space controlling color coordinates in a UV color coordinate system.

Referring to FIG. 5, in a UV color coordinate system, the color coordinates of the red, green and blue colors are represented as UV coordinates. For example, the color temperature of the light generated by the light source is in a range of absolute temperature of about 4500K to about 12000K.

TABLE 2A

| | R | G | B |
|---|---|---|---|
| U | 0.5388 | 0.0663 | 0.1663 |
| V | 0.5164 | 0.5772 | 0.1859 |

TABLE 2B

| | R | G | B |
|---|---|---|---|
| U | 0.5383 | 0.0662 | 0.1717 |
| V | 0.5159 | 0.5768 | 0.1713 |

TABLE 2C

| | R | G | B |
|---|---|---|---|
| U | 0.5368 | 0.0652 | 0.1731 |
| V | 0.5153 | 0.5766 | 0.1669 |

TABLE 2D

| | R | G | B |
|---|---|---|---|
| U | 0.5370 | 0.0655 | 0.1761 |
| V | 0.5150 | 0.5764 | 0.1590 |

TABLE 2E

| | R | G | B |
|---|---|---|---|
| U | 0.5349 | 0.0648 | 0.1811 |
| V | 0.5136 | 0.5758 | 0.1451 |

TABLE 2F

| | R | G | B |
|---|---|---|---|
| U | 0.5341 | 0.0651 | 0.1839 |
| V | 0.5129 | 0.5756 | 0.1379 |

In Table 2A, the color temperature of the light generated by the light source is about 4840K and a covering ratio of the color space of the light source to the reference color space is about 98.021%. In Table 2B, the color temperature of the light generated by the light source is about 5449K and the covering ratio of the color space of the light source to the reference color space is about 99.007%. In Table 2C, the color temperature of the light generated by the light source is about 6552K and the covering ratio of the color space of the light source to the reference color space is about 99.866%. In Table 2D, the color temperature of the light generated by the light source is about 6754K and the covering ratio of the color space of the light source to the reference color space is about 99.440%. In Table 2E, the color temperature of the light generated by the light source is about 9866K and the covering ratio of the color space of the light source to the reference color space is about 99.172%. In Table 2F, the color temperature of the light generated by the light source is about 12062K and the covering ratio of the color space of the light source to the reference color space is about 98.900%. For example, as illustrated in FIG. 6, the reference color space may be formed by the red reference color coordinates of (0.441, 0.528), the green reference color coordinates of (0.076, 0.576), and the blue reference color coordinates of (0.175, 0.158).

Referring to Tables 2A to 2F, in the UV color coordinate system, u-components and v-components of the color coordinates of the red and green colors may generally decrease when the color temperature increases. In the UV color coordinate system, the u-component of the color coordinates of the blue color increases and the v-component of the color coordinates of the blue color decreases when the color temperature increases. In addition, the covering ratio of color space of the light source to the reference color space is changed according to change of the color coordinates of the red, green and blue colors. The changing ratio of the color coordinates of the red color according to the change of the color temperature is smaller than the changing ratio of the color coordinates of the green and blue colors according to the change of the color temperatures.

In the present exemplary embodiment, a relation between the u-component of the color coordinates of the green color and the v-component of the color coordinates of the green color according to an increase of the color temperature of the light generated by the light source may be represented as an equation concerning the color coordinates of the green color.

For example, the equation concerning the color coordinates of the green color may be deduced through the polynomial regression method. The equation concerning the color coordinates of the green color may be represented as $v1=E+F_1u1+F_2u1\hat{}2$, wherein E=0.025, F1=15.956 and F2=−115.078. u1 and v1 respectively correspond to the u-component of the color coordinates of the green color and the v-component of the color coordinates of the green color. According to the equation concerning the color coordinates of the green color and Tables 2A to 2F, the u-component and the v-component of the color coordinates of the green color decrease when the color temperature increases.

A relation between the u-component of the color coordinates of the blue color and the v-component of the color coordinates of the blue color according to an increase of the color temperature of the light generated by the light source may be represented as an equation concerning the color coordinates of the blue color.

For example, the equation concerning the color coordinates of the blue color may be deduced through a linear regression method. The equation concerning the color coordinates of the blue color may be represented as v2=G+Hu2, wherein G=0.641 and H=−2.737. u2 and v2 respectively correspond to the u-component and the v-component of the color coordinates of the blue color. According to the equation concerning the color coordinates of the blue color and Tables 2A to 2F, the u-component of the color coordinates of the blue color increases and the v-component of the color coordinates of the blue color decreases when the color temperature increases.

A lookup table may be formed to illustrate the relation of the color temperature and the color coordinates of the red, green and blue colors because the color coordinates of the red, green and blue colors are changed in the pattern according to the variation of the color temperature. The lookup table may then be used as a reference for controlling color temperature so that the light source color space covers the reference color space.

Referring to FIG. 6, a specific region, which is referred to as a color coordinate controlling region hereinafter, is determined so that the color space of the light source covers the reference color space. The color coordinate controlling region includes a red color coordinate controlling region R, a green color coordinate controlling region G and a blue color coordinate controlling region B. The color coordinates of the red color are in a red color coordinate controlling region R, the color coordinates of the green color are in a green color coordinate controlling region G and the color coordinates of the blue color are in a blue color coordinate controlling region B so that the color space of the light source covers the reference color space.

In the exemplary UV color coordinate system, the reference color space is formed by the red reference color coordinates of (0.441, 0.528), the green reference color coordinates of (0.076, 0.576), and the blue reference color coordinates of (0.175, 0.158). For example, the reference color space is formed by a fourth line, which is represented as an equation of v=−0.031u+0.586 and connects the red reference color coordinates with the green reference color coordinates, a fifth line, which is represented as an equation of v=−4.22u+0.896 and connects the green reference color coordinates with the blue reference color coordinates, and a sixth line, which is represented as an equation of v=1.391u−0.085 and connects the blue reference color coordinates with the red reference color coordinates.

The red color coordinate controlling region R corresponds to an outside region of the reference color space adjacent to the red reference color coordinates. For example, the red color coordinate controlling region R is disposed between the fourth line and the sixth line, and the u-component of the color coordinates in the red color coordinate controlling region R is greater than the u-component of the red reference color coordinates. In the exemplary embodiment, the u-component of the color coordinates in the red color coordinate controlling region R is greater than 0.441.

The green color coordinate controlling region G corresponds to an outside region of the reference color space adjacent to the green reference color coordinates. For example, the green color coordinate controlling region G is disposed between the fourth line and the fifth line, and the v-component of the color coordinates in the green color coordinate controlling region G is greater than the v-component of the green reference color coordinates. In the exemplary embodiment, the v-component of the color coordinates in the green color coordinate controlling region G is greater than 0.576.

The blue color coordinate controlling region B corresponds to an outside region of the reference color space adjacent to the blue reference color coordinates. For example, the blue color coordinate controlling region B is disposed between the fifth line and the sixth line, and the v-component of the color coordinates in the blue color coordinate controlling region B is smaller than the v-component of the blue reference color coordinates. In the exemplary embodiment, the v-component of the color coordinates in the blue color coordinate controlling region B is less than 0.158.

The color coordinates of the red, green and blue colors may be moved into the red, green and blue color coordinate controlling regions R, G, B by a change of the color temperature based on the equations and the color coordinate controlling regions R, G, B.

For example, the color coordinates of the red, green and blue colors may be changed by using the above-described lookup table illustrating the relationship between the color temperature and the color coordinates. The u-components and the v-components of the red, green and blue colors may be changed based on the equations to be in the red, green and blue color coordinate controlling regions R, G, B.

When the equations concerning the color coordinates of the red, green and blue colors according to the color temperature are determined, the color coordinates of the red, green and blue colors are moved into the color coordinate controlling regions R, G, B so that the color space of the light source covers the reference color space.

Figure 7:
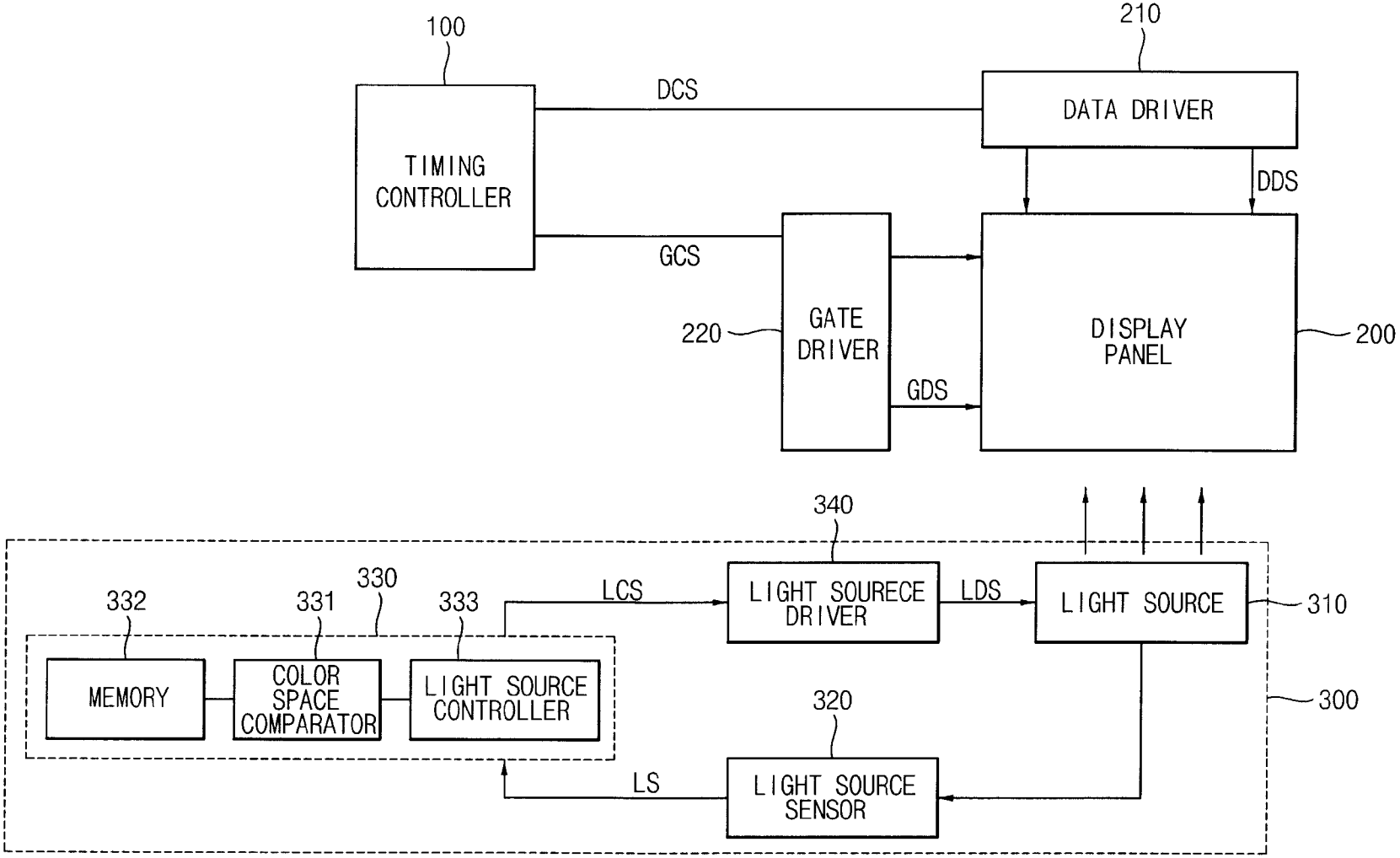
FIG. 7 is a block diagram illustrating an exemplary display apparatus according to another exemplary embodiment of the present invention.

FIG. 7 is a block diagram illustrating an exemplary display apparatus according to another exemplary embodiment of the present invention.

Referring to FIG. 7, a display apparatus according to an exemplary embodiment of the present invention includes a timing controller 100, a display unit, and a backlight assembly 300.

The timing controller 100 receives an external signal from an external graphic controller (not shown). The timing controller 100 applies an image control signal to the display unit in response to the external signal. For example, the image control signal may include a data control signal DCS and a gate control signal GCS.

The display unit receives light from the backlight assembly 300. The display unit displays an image using the light in response to the image control signal. The display unit may include a driving circuit and a display panel 200.

The driving circuit applies an image driving signal to the display panel 200 in response to the image control signal. For example, the image driving signal may include a data driving signal DDS and a gate driving signal GDS.

For example, the driving circuit may include a data driver 210 and gate driver 220. The data driver 210 applies the data driving signal DDS to the display panel 200 in response to the data control signal DCS. The gate driver 220 applies the gate driving signal GDS to the display panel 200 in response to the gate control signal GCS. For example, the data driver 210 and the gate driver 220 may be formed through a tape carrier package ("TCP") type or a chip-on-film ("COF") type.

The display panel 200 is driven by the image driving signal applied by the driving circuit, and displays an image using the light generated by the backlight assembly 300. For example, the display panel 200 may include a first substrate, a second substrate opposite to the first substrate, and a liquid crystal layer disposed between the first substrate and the second substrate.

For example, the first substrate may include a thin-film transistor ("TFT") substrate. The TFT substrate includes a plurality of pixels and each of the pixels includes signal lines formed in a matrix shape, a TFT that is a switching element, and a pixel electrode. The TFT includes a source terminal and a gate terminal connected to the signal lines, and a drain terminal connected to the pixel electrode which is formed using a transparent conductive material.

The second substrate may include a color filter substrate. The color filter substrate includes RGB color filters formed in a thin-film shape. A common electrode may be formed on the second substrate. The common electrode may include a transparent conductive material and may be formed to face the pixel electrodes of the TFT substrate. Alternatively, the color filters may be formed on the first substrate.

The RGB color filters transmit light having predetermined wavelengths generated by the backlight assembly. For example, the color filters may include a red color filter, a green color filter and a blue color filter. The red color filter transmits red light. The green color filter transmits green light. The blue color filter transmits blue light.

The red, green and blue color filters control an amount of light passing through the display panel 200 so that purity of colors may be improved.

In the display panel 200, a data signal is applied to the pixel electrode via the signal lines and drain electrode so that an electric field may be formed between the pixel electrode and the common electrode when the gate signal is applied to the gate terminal of the TFT so that the TFT turns on. The electric field changes arrangement of liquid crystal molecules in the liquid crystal layer. The arrangement of the liquid crystal molecules controls an amount of light passing through the liquid crystal layer so that the display panel 200 displays images having various grayscales.

The backlight assembly 300 provides the display unit with light. The backlight assembly 300 includes a light source 310, a light source sensor 320, a color space controller 330, and a light source driver 340.

The light source 310 receives a driving voltage to generate light. The light source 310 includes a plurality of light-emitting chips, each of which generates light having a single color. For example, the light source 310 may include a red light-emitting chip generating red light, a green light-emitting chip generating green light and a blue light-emitting chip generating blue light.

Each of the red, green and blue light-emitting chips may include a P-N junction semiconductor, such as formed by combining N-type and P-type semiconductors together in close contact, and convert electric energy into light energy. A wavelength of light generated by the red, green and blue light-emitting chips changes according to impurities added to the semiconductor. For example, an example of a material included in the red light-emitting chip may include aluminum gallium arsenide (AlGaAs), gallium phosphate (GaP), aluminum indium gallium phosphate (AlInGaP), etc., an example of a material included in the green light-emitting may include gallium arsenic phosphate (GaAsP), gallium phosphate (GaP), aluminum indium gallium phosphate (AlInGaP), etc., and an example of a material included in the blue light-emitting chip may include gallium nitride (GaN), silicon carbide (SiC), etc. These may be used alone or in a combination thereof.

A wavelength of the light generated by the light source 310 may be in a predetermined region and the light generated by the light source 310 may have a predetermined half amplitude, as will be further described below with respect to FIG. 8, so that regions in which at least two of a wavelength region of the red light, a wavelength region of the green light and a wavelength region of the blue light overlap with each other is minimized. The purity of colors of the light generated by the light source 310 may be improved when the regions, in which the wavelength region of the red light, the wavelength region of the green light and the wavelength region of the blue light overlap with each other, are minimized.

The light source sensor 320 senses light generated by the light source 310 and applies a light amount signal LS, which has a voltage level corresponding to an amount of the sensed light, to the color space controller 330. The light amount signal LS may include a red light amount signal, a green light amount signal and a blue light amount signal. For example, the light source sensor 320 may include a red optical sensor sensing the red light, a green optical sensor sensing the green light and a blue optical sensor sensing the blue light.

The color space controller 330 receives the light amount signal LS and determines the color space of the light source through the light sensed by the light source sensor 320 and determines whether the color space of the light source covers the reference color space. When the color space of the light source does not cover the reference color space, the color space controller 330 controls the color temperature of the light generated by the light source 310 so that the color space of the light source covers the reference color space. For example, the color space controller 330 may include a microcontroller unit ("MCU") that is a processor for controlling a predetermined system. In an exemplary embodiment of the present invention, the color space controller 330 may continuously control the color temperature of the light generated from the light source 310 in real-time according to the light generated from the light source 310. In another exemplary embodiment of the present invention, the color space controller 330 may discontinuously control the color temperature of the light generated from the light source 310 in random intervals or regular intervals according to the light generated from the light source 310.

In color coordinates system, the color space of the light source is formed by color coordinates of the red color, color coordinates of the green color and color coordinates of the blue color which respectively correspond to the red light amount signal, the green light amount signal and the blue light amount signal of the light amount signal LS. In the color coordinate system, the reference color space is formed by red reference color coordinates, green reference color coordinates and blue reference color coordinates. For example, the reference color space may include the Adobe RGB color space.

The color space controller 330 may include a color space comparator 331, a memory 332 and a light source controller 333.

The color space comparator 331 compares the color space of the light source with the reference color space. For example, the color space comparator 331 may compare the color coordinates of the red color, the color coordinates of the green color and the color coordinates of the blue color with the red reference color coordinates, the green reference color coordinates and the blue reference color coordinates to determine whether the color space of the light source covers the reference color space.

The memory 332 stores a lookup table and equations concerning the color coordinates which show variations of the red, green and blue color coordinates according to the color temperature.

The lookup table may include data concerning the relation between the color temperature and the color coordinates of the red, green and blue colors, as previously described with reference to Tables 1A to 1F and 2A to 2F.

The equations concerning the color coordinates may illustrate a variation of the color space of the light source according to the color temperature. For example, the equations concerning the color coordinates may include an equation concerning the color coordinates of the red color, an equation concerning the color coordinates of the green color and an equation concerning the color coordinates of the blue color. The equations concerning the color coordinates of the red, green and blue colors may illustrate a relation between the x-components and the y-components of the color coordinates of the red, green and blue colors according to the color temperature. The equations concerning the color coordinates of the red, green and blue colors may be substantially the same as the equations explained above. Thus, any repetitive explanation concerning the equations will be omitted.

The light source controller 333 controls the light source driver 340. The light source driver 340 controls the color temperature so that the color space of the light source covers the reference color space. The light source controller 333 outputs control signals, such as a light source control signal LCS, changing the color coordinates of the red, green and blue colors into predetermined color coordinates, based on the color coordinates and the equations concerning the color coordinates according to the color temperature read out from the memory 332.

In an exemplary embodiment of the present invention, the light source controller 333 applies the light source control signal LCS to the light source driver 340 to control the amount of the light generated by the light source 310. For example, the light source control signal LCS may include a red control signal controlling the amount of the red light, a green control signal controlling the amount of the green light and a blue control signal controlling the amount of the blue light. The light source control signal LCS may include a pulse width modulation signal PWM of which a pulse width is modulated. The light source control signal LCS may be directly applied to the light source driver 340.

The color space controller 330 applies the light source control signal LCS to the light source driver 340 to control the color temperature of the light generated by the light source 310. The color temperature corresponds to color coordinates of white light generated by the light source 310. When the color temperature is changed, the color coordinates of the white color may be changed and the color space formed by the color coordinates of the red, green and blue colors may be changed. Thus, when the color space of the light source does not cover the reference color space, the color temperature of the light may be controlled to change the color space of the light source.

The color space comparator 331 may calculate a covered area CA of the reference color space which is covered by the color space of the light source. The color space comparator 331 may calculate the covered area CA of the reference color space before applying the light source control signal LCS to the light source driver 340. When a covering ratio at which the reference color space is covered by the color space of the light source is smaller than about 99%, or smaller than a defined reference ratio, the color space comparator 331 applies the light source control signal LCS to the light source driver 340. However, when the covering ratio is in a range of about 99% to about 100%, or greater than a defined reference ratio, the color space comparator 331 may not apply the light source control signal LCS to the light source driver 340.

The light source driver 340 applies the light source driving signal LDS to the light source 310 in response to the light source control signal LCS applied from the color space controller 330. The light source driving signal LDS controls a driving current applied to the light source 310. The light source driving signal LDS may include a red driving signal applied to the red light-emitting chip, a green driving signal applied to the green light-emitting chip and a blue driving signal applied to the blue light-emitting chip. For example, the light source driver 340 may apply the red driving signal to the red light-emitting chip in response to the red control signal, the green driving signal to the green light-emitting chip in response to the green control signal and the blue driving signal to the blue light-emitting chip in response to the blue control signal.

The light source driver 340 may control the driving current applied to the red, green and blue light-emitting chips to control the amount of the red light, the amount of the green light and the amount of the blue light respectively generated by the red, green and blue light-emitting chips. That is, the light source driver 340 may control the amount of the red light, the amount of the green light and the amount of the blue light generated by the light source 310 to change the color coordinates of the red, green and blue colors forming the color space of the light source.

The light source driver 340 may control the driving current applied to the light source 310 in real-time. Alternatively, the light source driver 340 may control the light source 310 by a predetermined time interval through a method where the color space controller 330 applies a timing control signal to the light source driver 340.

Figure 8:
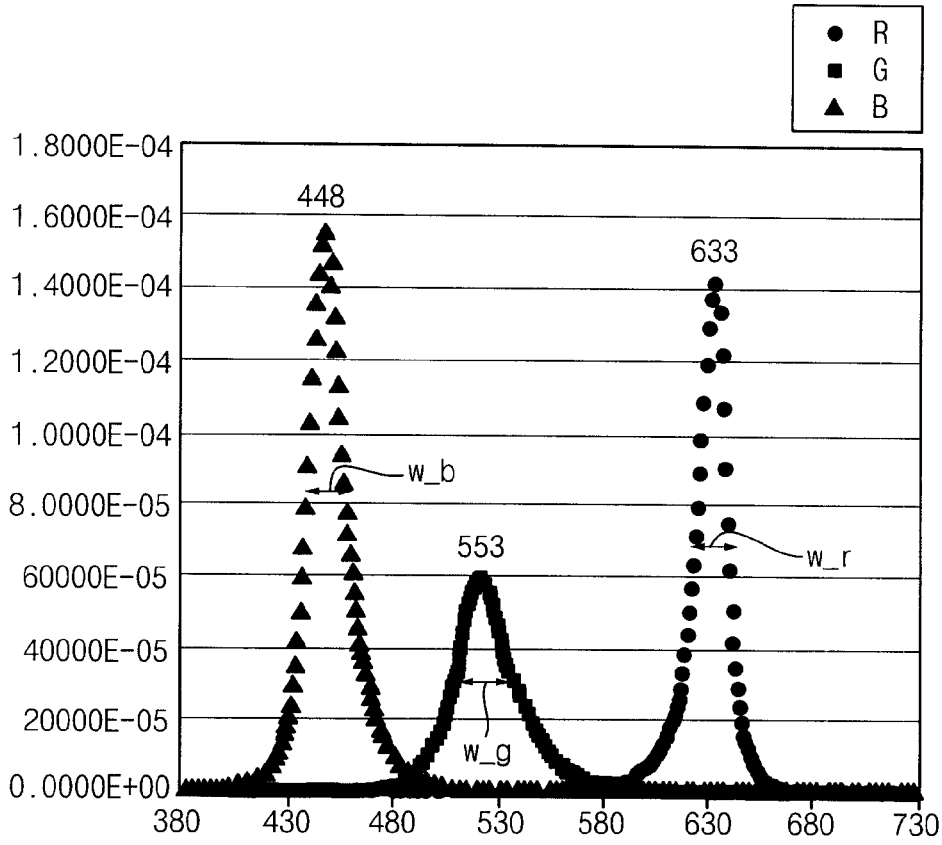
FIG. 8 is a graph illustrating a spectrum of a wavelength of light generated by the exemplary light source shown in FIG. 7.

FIG. 8 is a graph illustrating a spectrum of a wavelength of light generated by the exemplary light source shown in FIG. 7.

Referring to FIGS. 7 and 8, the light source 310 includes the red, green and blue light-emitting chips and a wavelength spectrum of light generated by the red, green and blue light-emitting chips will be described.

The red light generated by the red light-emitting chip has a wavelength in a range of about 620 nm to about 630 nm. The green light generated by the green light-emitting chip has a wavelength in a range of about 525 nm to about 535 nm. The blue light generated by the blue light-emitting chip has a wavelength in a range of about 445 nm to about 455 nm.

A half amplitude w_r of the red light is about 15 nm or less, a half amplitude w_g of the green light is about 30 nm or less, and a half amplitude w_b of the blue light is about 19 nm or less. The current applied to the red, green and blue light-emitting chips is about 20 mA. The half amplitude refers to a distance between two wavelengths at which the light has half of a maximum intensity. For example, the distance between the wavelengths at which the blue light has half ($8\times e^{-5}$) of the maximum intensity ($1.6\times e^{-4}$) is about 19 nm.

For example, the half amplitude of the light generated by the light source 310 may be changed according to an interface contact resistance of the red, green and blue light-emitting chips and or an amount of impurity added to the light-emitting chips during a process of manufacturing the light-emitting chips. When the interface contact resistance of the red, green and blue light-emitting chips or the amount of the impurity is controlled, the half amplitude of the light generated by the red, green and blue light-emitting chips may be controlled. In addition, the red, green and blue light-emitting chips include impurities to emit light having specific colors and the wavelength of the light generated by the light source 310 may be controlled by an amount of the impurities.

TABLE 3

| | CIE 1931 | | CIE 1976 | |
|---|---|---|---|---|
| | x | y | u' | v' |
| R | 0.6913 | 0.2956 | 0.5354 | 0.5151 |
| G | 0.1926 | 0.7150 | 0.0688 | 0.5748 |
| B | 0.1461 | 0.0822 | 0.1582 | 0.2002 |
| GAMUT | 105.9067 | | 113.8571 | |

TABLE 4

| | CIE 1931 | | CIE 1976 | |
|---|---|---|---|---|
| | x | y | u' | v' |
| R | 0.6854 | 0.2961 | 0.5290 | 0.5142 |
| G | 0.1928 | 0.7210 | 0.0685 | 0.5760 |
| B | 0.1503 | 0.0764 | 0.1663 | 0.1901 |
| GAMUT | 106.0645 | | 115.3300 | |

TABLE 5

| | CIE 1931 | | CIE 1976 | |
|---|---|---|---|---|
| | x | y | u' | v' |
| R | 0.6848 | 0.2940 | 0.5310 | 0.5129 |
| G | 0.1919 | 0.7215 | 0.0681 | 0.5760 |
| B | 0.1516 | 0.0753 | 0.1684 | 0.1882 |
| GAMUT | 106.1126 | | 116.3472 | |

Referring to Tables 3 to 5, the color coordinates of the red, green and blue colors of the light generated by the light source will be described hereinafter in accordance with a variation of the wavelength of the blue light generated by the blue light-emitting chip. The color coordinates of the red, green and blue colors may be illustrated in the XY color coordinate system (CIE 1931) and the UV color coordinate system (CIE 1976).

In an exemplary embodiment of the present invention, the red light generated by the red light-emitting chip has a maximum intensity at a peak wavelength of about 624.3 nm, the green light generated by the green light-emitting chip has a maximum intensity at a peak wavelength of about 530.5 nm, and the blue light generated by the blue light-emitting chip has a maximum intensity at a peak wavelength of about 445 nm to about 455 nm. In Table 3, the blue light has the maximum intensity at a peak wavelength of about 454 nm. In Table 4, the blue light has the maximum intensity at a peak wavelength of about 447.5 nm to about 450 nm. In Table 5, the blue light has the maximum intensity at a peak wavelength of about 445 nm to about 447.5 nm.

Referring to Tables 3 to 5, when the peak wavelength of the blue light decreases, the color space of the light source GAMUT formed by the color coordinates of (Rx, Ry), (Gx, Gy) and (Bx, By) (or (Ru', Rv'), (Gu', Gv') and (Bu', Bv')) may be extended. That is, the wavelength of the light generated by the red, green and blue light-emitting chips is controlled to extend the color space of the light source GAMUT.

When a display apparatus includes the light source 310 according to an exemplary embodiment of the present invention, the display apparatus has a broad color space of the light source. Therefore, the color space of the light source may cover the Adobe RGB color space.

Alternatively, when the light source 310 includes not a white light-emitting chip for emitting white light but the red, green and blue light-emitting chips, the half amplitude of the light may decrease so that a spectrum of the red, green and blue light may have a sharp shape. Therefore, a region in which the wavelength spectrums of the red, green and blue light overlap with each other may decrease so that the purity of the colors of the light may be improved.

Figure 9A:
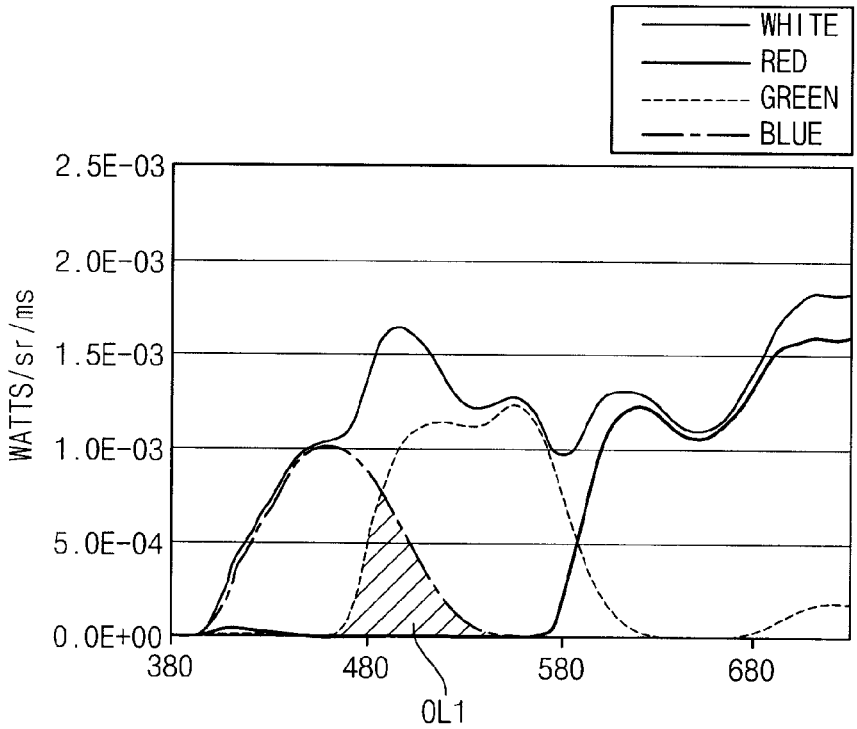
FIGS. 9A and 9B are graphs illustrating variations of spectrums according to color filters employed in an exemplary display panel shown in FIG. 7.
Figure 9B:
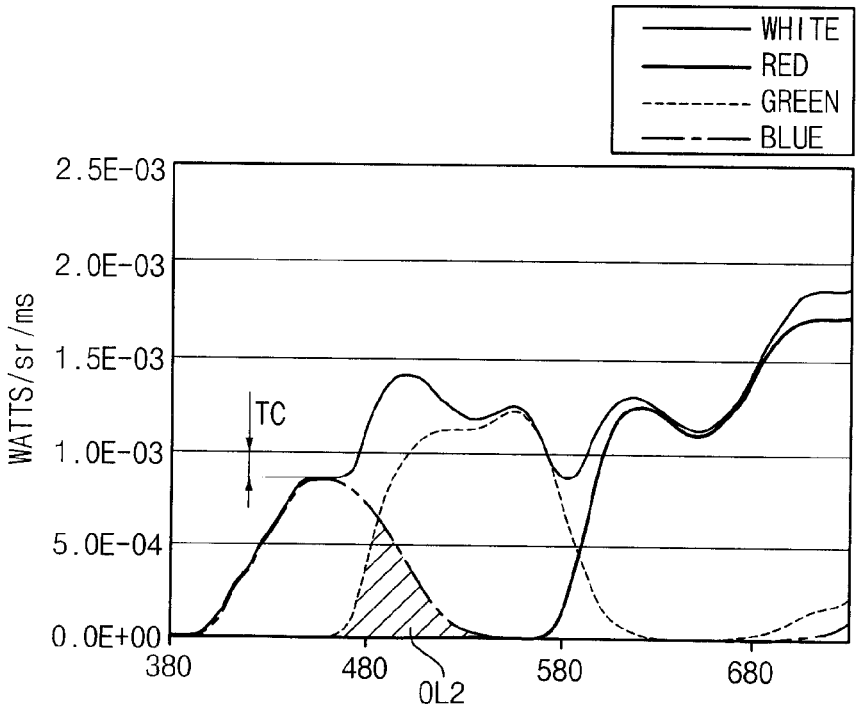

FIGS. 9A and 9B are graphs illustrating variations of spectrums according to color filters employed in an exemplary display panel shown in FIG. 7.

Referring to FIG. 7, the display panel 200 displays an image using the light generated from the backlight assembly 300. Therefore, the display apparatus may display a colored image since the red, green and blue color filters formed in the display panel 200 determines a wavelength range of light passing through the display panel 200.

In an exemplary embodiment of the present invention, the color filters formed in the display panel 200 decreases a region in which wavelength regions of the red, green and blue light overlap with each other. The color filter may control a wavelength spectrum passing therethrough. Therefore, the wavelength spectrum passing through the color filter may match the wavelength spectrum of the light generated by the light source 310.

Referring to FIG. 9A, a display panel 200 according to a comparative example includes a red color filter, a green color filter and a blue color filter. Light having a wavelength of about 580 nm may pass through the red color filter. Light having a wavelength of about 480 nm to about 620 nm may pass through the green color filter. Light having a wavelength of about 400 nm to about 530 nm may pass through the blue color filter. A wavelength region of the light, which has a peak wavelength of about 560 and passes through the red color filter overlaps with a wavelength region of the light, which has a peak wavelength of about 517 nm and passes through the green color filter in a wavelength region near to about 600 nm. In addition, the wavelength region of the light passing through the green color filter overlaps with a wavelength region of the light passing through the blue color filter in a wavelength region near to about 500 nm.

The region OL1 in which the wavelength region of the light passing through the green color filter overlaps with the wavelength region of the light passing through the blue color filter may have greater area than the region in which the wavelength region of the light passing through the red color filter overlaps with the wavelength region of the light passing through the green color filter. Light having a wavelength near to about 500 nm may pass through both the blue color filter and the green color filter. Therefore, when the display apparatus displays an image using the light passing through both the blue color filter and the green color filter, the quality of a displayed image may be deteriorated.

The transmissivity of the light and the half amplitude of the light may have an effect on the region in which the wavelength region passing through the color filters different from each other. Therefore, the transmissivity of the light is controlled to control the region in which the wavelength region passes through the color filters different from each other.

In an exemplary embodiment of the present invention, the transmissivity of the light passing through the red, green and blue color filters may be controlled so that the region in which the wavelength region passing through the color filters different from each other may be decreased. For example, when the blue color filter has a greater thickness than the green color filter and an amount of light absorbed by the blue color filter is greater than an amount of light absorbed by the green color filter, the transmissivity of the light passing through the blue color filter may be smaller than the transmissivity of the light passing through the green color filter.

For example, the light passing through the blue color filter has a peak wavelength of about 440 nm to about 460 nm and the light passing through the green color filter has a peak wavelength of about 515 nm to about 519 nm. The transmissivity of the light passing through the green color filter is about $1.1\times e^{-3}$ at the peak wavelength and the transmissivity of the light passing through the blue color filter is about $8.4\times e^{-4}$ at the peak wavelength.

When the thickness of the blue color filter is different from the thickness of the green color filter, the transmissivity G_T of the light passing through the green color filter is more than about $1.1\times e^{-3}$ at the peak wavelength and the transmissivity of the light passing through the blue color filter is less than about $8.4\times e^{-4}$ at the peak wavelength. Therefore, a ratio of the transmissivity of the light passing through the blue color filter to the transmissivity of the light passing through the green color filter is less than about $(8.4\times e^{-4})/(1.1\times e^{-3})$.

Referring to FIG. 9B, when the transmissivity of the light passing through the blue color filter is less than $1.0\times e^{-3}$ by a transmissivity change amount TC, the half amplitude of the blue light passing through the blue color filter decreases. That is, the wavelength region of the blue light passing through the blue color filter decreases so that a region OL2 in which the wavelength region of the light passing through the green color filter overlaps with the wavelength region of the light passing through the blue color filter has an area smaller than the region OL1 shown in FIG. 9A in which the wavelength region of the light passing through the blue color filter overlaps with the wavelength region of the light passing through the green color filter before the transmissivity is controlled. Accordingly, impurities of the blue and green colors passing through the blue and green color filters may be improved.

TABLE 6

| | CIE 1931 | | CIE 1976 | |
|---|---|---|---|---|
| | x | y | u' | v' |
| R | 0.6931 | 0.2971 | 0.5353 | 0.5163 |
| G | 0.1875 | 0.7286 | 0.0660 | 0.5768 |
| B | 0.1513 | 0.0636 | 0.1749 | 0.1654 |
| GAMUT | 111.2024 | | 125.3042 | |

TABLE 7

| | CIE 1931 | | CIE 1976 | |
|---|---|---|---|---|
| | x | y | u' | v' |
| R | 0.6936 | 0.2956 | 0.5377 | 0.5156 |
| G | 0.1865 | 0.7293 | 0.0656 | 0.5768 |
| B | 0.1525 | 0.0638 | 0.1763 | 0.1659 |
| GAMUT | 111.3214 | | 125.7851 | |

Tables 6 and 7 illustrate the color reproducibility of the display panel according to exemplary embodiments of the present invention. In Table 6, the color space of the light source of Table 4 is shown. In Table 7, the color space of the light source of Table 5 is shown.

Referring to Tables 6 and 7, when the peak wavelength of the light generated by the red, green and blue light-emitting chips is changed and the transmissivity of the light passing through the color filter is controlled, a ratio of the color space of the light source GAMUT to the reference color space may be changed. For example, when the reference color space is CIE1931, the ratio is about 111%. For example, when the reference color space is CIE1976, the ratio is about 125%. Therefore, when the peak wavelength of the light generated by the blue light-emitting chip is changed to control the color space of the light source and the transmissivity of the light passing through the color filter is controlled, the color reproducibility may be improved.

Figure 10:
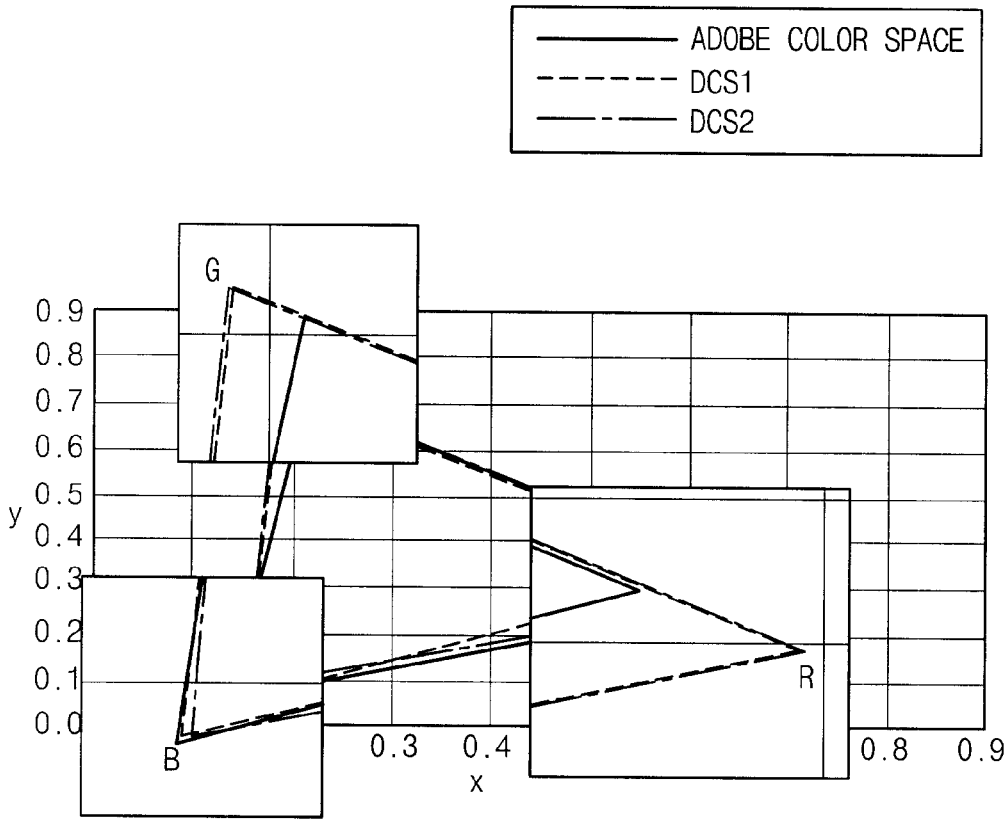
FIG. 10 is a graph illustrating the color reproducibility of the exemplary display apparatus shown in FIG. 7.

FIG. 10 is a graph illustrating the color reproducibility of the exemplary display apparatus shown in FIG. 7.

Referring to FIGS. 7, 8, 9A, and 10, the color reproducibility of the display apparatus may be improved when the peak wavelength of the light generated by the blue light-emitting chip and the transmissivity of the light passing through the color filter are controlled. Hereinafter, the color space of the display apparatus is compared with the Adobe RGB color space in the XY color coordinate system.

Hereinafter, the covering ratio of the color space of the display apparatus to the Adobe RGB color space will be described. The color space of the display apparatus includes a first display color space DCS1 and a second display color space DCS2. In the first display color space DCS1, the peak wavelength of the blue light generated by the light source 310 is in a range of about 447.5 nm to about 450 nm. In the second color space DCS2, the peak wavelength of the light generated by the light source is in a range of about 445 nm to 447.5 nm. The first and second display color spaces DCS1 and DCS2 are a color space of the display panel 200 having optimized transmissivity (refer to FIG. 9B).

A first covering ratio at which the first display color space DCS1 covers the Adobe RGB color space is about 99.952% and a second covering ratio at which the second display color space DCS2 covers the Adobe RGB color space is about 99.905%. The central brightness of the display apparatus is about 120 nit. The color coordinates of white color of the first and second display color spaces DCS1 and DCS2 are (0.313, 0.329). The color temperature is about 6500K.

Referring to FIGS. 8 and 9B, a wavelength spectrum of the light source 310 is matched to a spectrum of light passing through the color filter so that the color space of the display apparatus may cover the Adobe RGB color space at a ratio of about 99.9%. Therefore, the display apparatus may have a color space covering the Adobe RGB color space at a ratio of about 100%.

Figure 11:
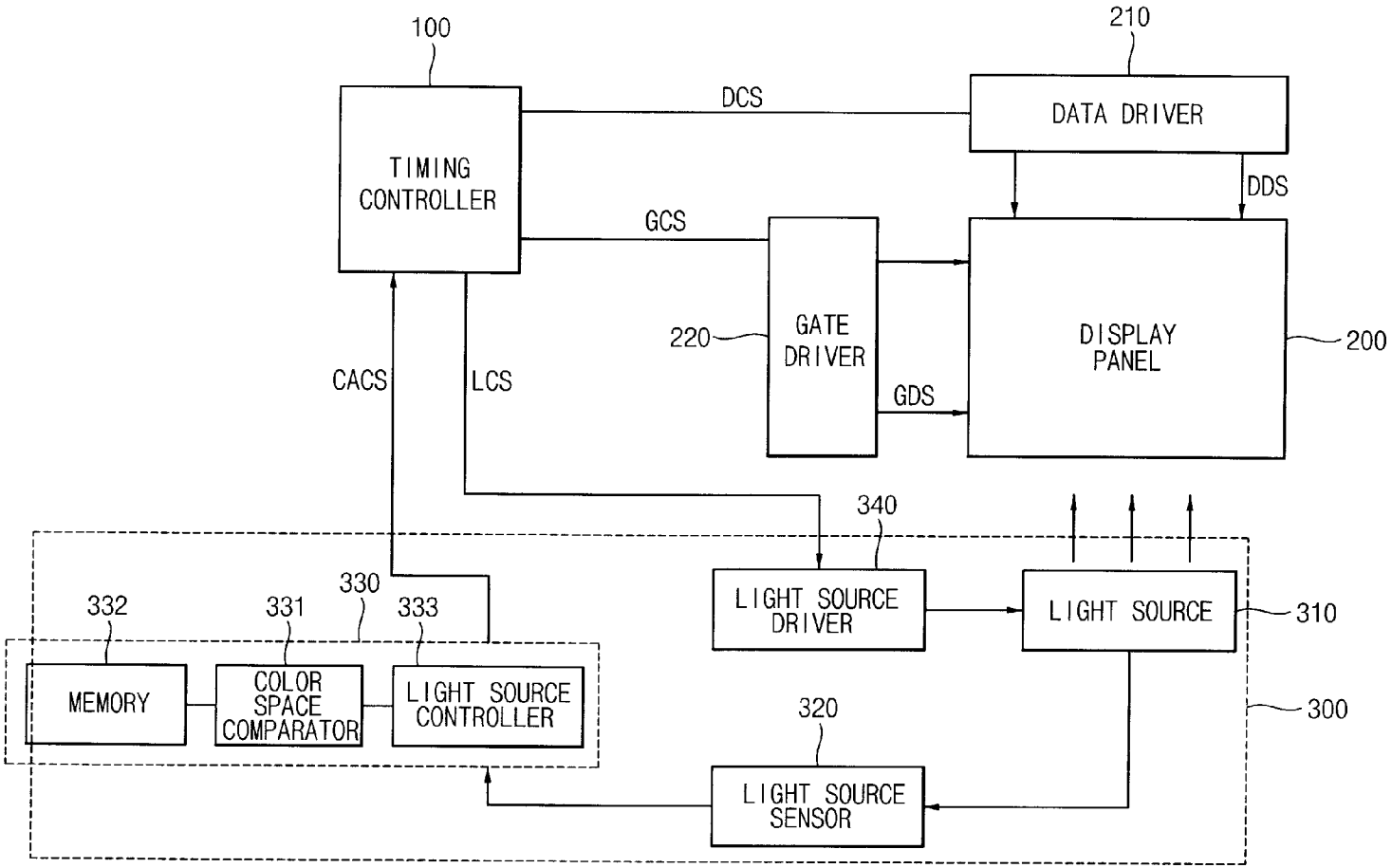
FIG. 11 is a block diagram illustrating an exemplary display apparatus according to still another exemplary embodiment of the present invention.

FIG. 11 is a block diagram illustrating an exemplary display apparatus according to still another exemplary embodiment of the present invention. A display apparatus according to an exemplary embodiment of the present invention includes substantially the same composition as the exemplary display apparatus described above and illustrated in FIG. 7 except for the timing controller controlling the light source driver. Thus, any repetitive explanation will be omitted. The same or a similar reference numeral will be referred to as the same or a similar component.

Referring to FIG. 11, the color space controller 330 applies a color space control signal CACS to the timing controller 100. The timing controller 100 applies a light source control signal LCS to the light source driver 340 in response to the color space control signal CACS. The light source driver 340 outputs a light source driving signal LDS in response to the light source control signal LCS applied by the timing controller 100. As a result, the color space controller 330 may indirectly control the light source driver 340 through the timing controller 100.

According to an exemplary method of driving a light source, an exemplary backlight assembly for performing the method and an exemplary display apparatus having the backlight assembly, the color temperature of light generated by the light source is controlled to change the color coordinates of red, green and blue colors forming a color space. Therefore, the color coordinates of the red, green and blue colors are changed so that the color space may cover the Adobe RGB color space, and the display apparatus may have the color space covering the Adobe RGB color space in spite of external causes such as a decrease of brightness caused by heating of the display apparatus.

The center of a wavelength region of light generated by the light source may be matched to the center of the wavelength of light passing through the color filter to decrease the size of a region in which the wavelength regions of the light generated by the light source overlap with each other. As a result, the impurity of the colors displayed by the display apparatus may be decreased and the color space of the display apparatus may cover the Adobe RGB color space.

Having described the exemplary embodiments of the present invention and their advantages, it is noted that various changes, substitutions and alterations can be made herein without departing from the spirit and scope of the invention as defined by appended claims.

What is claimed is:

1. A method of driving a light source, the method comprising:

sensing light generated by a light source to detect color coordinates of a red color, color coordinates of a green color and color coordinates of a blue color;

comparing a light source color space formed by the color coordinates of the red, green and blue colors with a reference color space formed by red reference color coordinates, green reference color coordinates and blue reference color coordinates; and controlling a color temperature of the light generated by the light source so that the light source color space covers the reference color space, wherein comparing the light source color space with the reference color space comprises determining a covering area of a region of the reference color space which is covered by the light source color space.

2. The method of claim 1, wherein controlling the color temperature is continuously performed in real-time according to the light generated by the light source.

3. The method of claim 1, wherein controlling the color temperature is discontinuously preformed in regular intervals.

4. The method of claim 1, wherein controlling the color temperature of the light comprises:

controlling a driving current applied to the light source so that the color coordinates of the red color, the color coordinates of the green color and the color coordinates of the blue color are respectively moved into a red color coordinate control region, a green color coordinate control region and a blue color coordinate control region.

5. The method of claim 4, wherein the red reference color coordinates are (0.64, 0.34), the green reference color coordinates are (0.21, 0.71) and the blue reference color coordinates are (0.15, 0.06) when the reference color space is represented in an XY color coordinate system, and a first line connects the red reference color coordinates with the green reference color coordinates, a second line connects the green reference color coordinates with the blue reference color coordinates, and a third line connects the blue reference color coordinates with the red reference color coordinates.

6. The method of claim 5, wherein the blue color coordinate control region is disposed between the second line and the third line, and the color coordinates in the blue color coordinate control region have a y-component smaller than a y-component of the blue reference color coordinates.

7. The method of claim 5, wherein the green color coordinate control region is disposed between the first line and the second line, and the color coordinates in the green color coordinate control region have a y-component greater than a y-component of the green reference color coordinates.

8. The method of claim 5, wherein the red color coordinate control region is disposed between the first line and the third line, and the color coordinates in the red color coordinate control region have an x-component greater than an x-component of the red reference color coordinates.

9. The method of claim 4, wherein the red reference color coordinates are (0.441, 0.528), the green reference color coordinates are (0.076, 0.576) and the blue reference color coordinates are (0.175, 0.158) when the reference color space is represented in a UV color coordinate system, and a first line connects the red reference color coordinates with the green reference color coordinates, a second line connects the green reference color coordinates with the blue reference color coordinates, and a third line connects the blue reference color coordinates with the red reference color coordinates.

10. The method of claim 9, wherein the blue color coordinate control region is disposed between the second line and the third line, and the color coordinates in the blue color coordinate control region have a v-component smaller than a v-component of the blue reference color coordinates.

11. The method of claim 9, wherein the green color coordinate control region is disposed between the first line and the second line, and the color coordinates in the green color coordinate control region have a v-component greater than a v-component of the green reference color coordinates.

12. The method of claim 9, wherein the red color coordinate control region is disposed between the first line and the third line, and the color coordinates in the red color coordinate control region have a u-component greater than a u-component of the red reference color coordinates.

13. The method of claim 4, wherein controlling the color temperature of the light, further comprises:

changing the color coordinates of the red, green and blue colors through a red color coordinate equation illustrating a variation of the color coordinates of the red color according to the color temperature, a green color coordinate equation illustrating a variation of the color coordinates of the green color according to the color temperature, and a blue color coordinate equation illustrating a variation of the color coordinates of the blue color according to the color temperature.

14. The method of claim 13, wherein a changing ratio of the color coordinates of the green color and a changing ratio of the color coordinates of the blue color are greater than a changing ratio of the color coordinates of the red color.

15. The method of claim 13, wherein an x-component and a y-component decrease as the color temperature increases in the red and green color coordinate equations, and an x-component increases and a y-component decreases as the color temperature increases in the blue color coordinate equations, when the color coordinates of the red, green and blue colors are represented in an XY color coordinate system.

16. The method of claim 13, wherein a u-component and a v-component decrease as the color temperature increases in the red and green color coordinate equations, and a u-component increases and a v-component decreases as the color temperature increases in the blue color coordinate equations, when the color coordinates of the red, green and blue colors are represented in a UV color coordinate system.

17. The method of claim 1, wherein controlling the color temperature of the light comprises:

controlling the color temperature when a cover ratio of the covering area to an area of the reference color space is smaller than a reference ratio.

18. The method of claim 17, wherein the reference ratio is about 99% to about 100%.

19. The method of claim 1, wherein a half amplitude of red light generated by the light source is about 15 nm or less, a half amplitude of green light generated by the light source is about 30 nm or less, and a half amplitude of blue light generated by the light source is about 19 nm or less.

20. The method of claim 19, wherein a wavelength of the red light is in a range of about 620 nm to about 630 nm, a wavelength of the green light is in a range of about 525 nm to about 535 nm, and a wavelength of the blue light is in a range of about 445 nm to about 455 nm.

21. A backlight assembly comprising:

a light source including a red light-emitting chip generating red light, a green light-emitting chip generating green light and a blue light-emitting chip generating blue light;

a light source driver applying a driving current to the light source to drive the light source;

a light source sensor sensing light generated by the light source; and a color space controller comparing a light source color space formed by color coordinates of a red color, color coordinates of a green color and color coordinates of a blue color, which are detected from the red light, the green light and the blue light, respectively, with a reference color space formed by red reference color coordinates, green reference color coordinates and blue reference color coordinates, and controlling a color temperature of the light generated by the light source, wherein comparing the light source color space with the reference color space comprises determining a covering area of a region of the reference color space which is covered by the light source color space.

22. The backlight assembly of claim 21, wherein the color space controller comprises:

a color space comparator comparing the light source color space with the reference color space to determine whether the light source color space covers the reference color space; and a light source controller controlling the light source driver such that the light source driver controls the color temperature so that the light source color space covers the reference color space.

23. The backlight assembly of claim 22, wherein the color space controller further comprises:

a memory storing a red color coordinate equation illustrating a variation of the color coordinates of the red color according to the color temperature, a green color coordinate equation illustrating a variation of the color coordinates of the green color according to the color temperature, and a blue color coordinate equation illustrating a variation of the color coordinates of the blue color according to the color temperature.

24. The backlight assembly of claim 21, wherein the color space controller continuously controls the color temperature in real-time according to the light generated by the light source.

25. The backlight assembly of claim 21, wherein the color space controller discontinuously controls the color temperature in regular intervals according to the light generated by the light source.

* * * * *